United States Patent [19]

Permar

[11] 4,263,055

[45] Apr. 21, 1981

[54] METHOD FOR CLEANING A PAINT ROLLER PAD

[76] Inventor: Elbert R. Permar, 312 Westwood Dr., Marshalltown, Iowa 50158

[21] Appl. No.: 65,992

[22] Filed: Aug. 13, 1979

[51] Int. Cl.[3] ..... B08B 1/04

[52] U.S. Cl. ..... 134/33; 134/38; 134/149; 269/48.1; 279/2 R

[58] Field of Search ..... 134/33, 38, 138, 149; 68/198, 213; 242/46.5, 68.2, 72 R; 279/2 R, 1 SG; 269/48.1

[56] References Cited

U.S. PATENT DOCUMENTS

| | | | |
|---|---|---|---|
| 970,189 | 9/1910 | Cunniff | 242/46.5 |
| 2,542,491 | 2/1951 | Engel | 134/33 X |
| 2,616,281 | 11/1952 | Calhoun | 68/213 X |
| 3,431,574 | 3/1969 | Mathieu | 68/213 X |
| 3,925,908 | 12/1975 | Dunn | 134/149 X |

FOREIGN PATENT DOCUMENTS

| | | | |
|---|---|---|---|
| 1295973 | 5/1969 | Fed. Rep. of Germany | 279/1 SG |

*Primary Examiner*—Marc L. Caroff
*Attorney, Agent, or Firm*—Zarley, McKee, Thomte, Voorhees & Sease

[57] ABSTRACT

A paint roller pad is cleaned while being supported on an apparatus including an elongated coil having a shank connected thereto and coaxially extended from one end thereof. When at rest, the coil has an outside diameter less than the inside diameter of the roller pad so that the coil may be axially inserted into the bore of the roller pad. Upon insertion, the coil is adapted to radially expand in response to rotation of the shank in a direction to unwind the coil with the result that the rotating coil engages the roller pad and rotates the same therewith. The method of the invention thus includes axially inserting a coil into the bore of a roller pad and rotating the coil in a direction to unwind the same, thereby radially expanding the coil to engage and rotate the roller pad while removing paint from an exterior portion of the pad.

2 Claims, 5 Drawing Figures

METHOD FOR CLEANING A PAINT ROLLER PAD

BACKGROUND OF THE INVENTION

The present invention relates to an apparatus and method for rotating an object having an elongated bore therein and more particularly to an apparatus and method for rotating a cylindrical paint roller pad to facilitate cleaning the same.

Paint rollers have been in widespread use for many years now generally because they may be used to more quickly and efficiently apply a coat of paint to large surfaces than can be accomplished with a conventional paint brush. Nevertheless, to applicant's knowledge, there has not yet been developed an apparatus or method for automating and facilitating the cleaning of the removable paint roller pads or covers. The cleaning of such pads requires considerable manual exertion to move the pads for purposes of working in a paint thinner, soap and water solution or the like for the purpose of diluting and removing paint from the pad. Generally a painter grasps the external circumference of the roller pad with one hand while cleaning the same with the other. Gripping the pad externally necessarily interferes with the cleaning operation. A pad can be supported internally by a paint roller but the roller would necessarily block access to at least one end of the pad and interfere with the cleaning thereof. It is believed that similar problems are applicable to other objects having elongated bores therein as well.

Accordingly, it is a primary object of the present invention to provide an apparatus and method for rotating an object having an elongated bore therein.

A more specific object is to provide an apparatus and method for rotating a cylindrical paint roller pad to facilitate cleaning and the like.

A further object of the invention is to provide such an apparatus which is simple in construction, durable in use and efficient in operation.

SUMMARY OF THE INVENTION

The present invention contemplates an apparatus and method for quickly and easily supporting and/or rotating an object having an enlongated bore therein such as a cylindrical paint roller pad, for example. The apparatus includes an elongated coil connected to a coaxial shank which extends from one end of the coil for rotating the same. With reference to a paint roller pad, the coil has an outside diameter slightly less than the inside diameter of the roller pad so that the coil may be easily inserted and withdrawn from the bore of the pad. Upon insertion of the coil into the pad, the shank may be rotated by an electric drill or other such power means in a direction to unwind the coil thereby causing the coil to radially expand, engage the roller pad and rotate the same therewith. When rotation is stopped, the coil retracts to its original diameter so that it may be freely withdrawn from the pad without resistance.

DESCRIPTION OF THE PREFERRED EMBODIMENT

Figure 1:
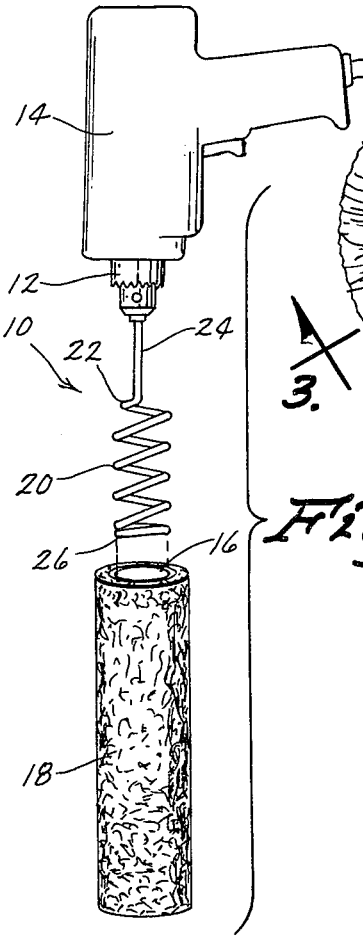
FIG. 1 is a side view of the apparatus of the invention in assembly relation with an electric drill and shown displaced from one end of a paint roller pad.

The apparatus 10 of the present invention is shown in FIG. 1 engaged within the chuck 12 of a conventional electric drill 14 and positioned in axial alignment with the bore 16 of a conventional paint roller pad or cover 18. The apparatus itself includes an elongated coil 20, one end 22 of which is bent radially inwardly toward the axial center line 22 of the coil and extended axially therefrom to form an elongated shank 24. The opposite end 26 of the coil may simply be directed normal to the axis of the coil so as to present a generally continuous annular end portion. As shown in FIG. 1, the shank 24 may be inserted into and grasped by the chuck 12 for rotating the shank 24 and coil 20 therewith in response to operation of the drill 14.

Figure 2:
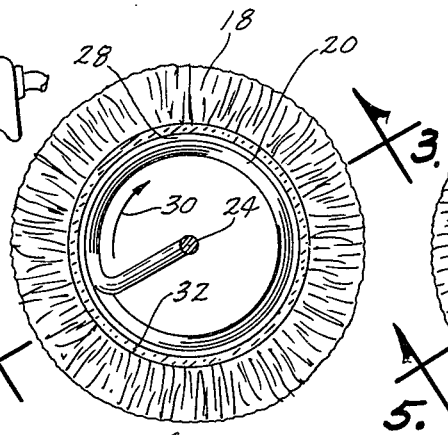
FIG. 2 is an enlarged partially sectional end view of the apparatus at rest and positioned within the bore of a paint roller pad.
Figure 3:
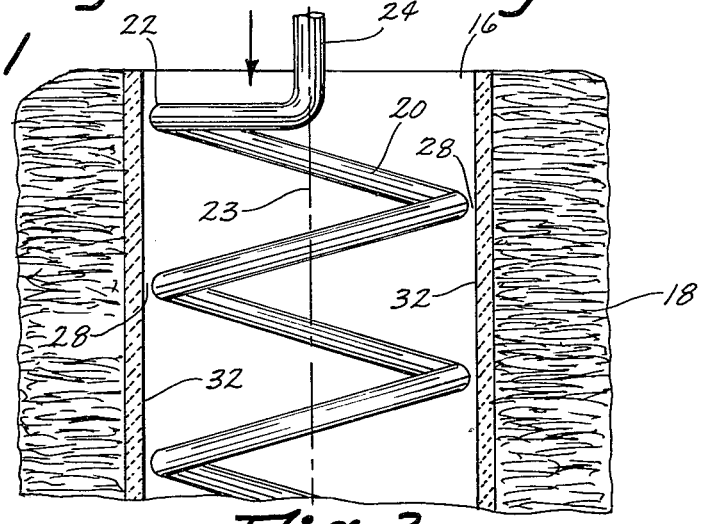
FIG. 3 is a further enlarged transverse sectional view as seen on line 3—3 of FIG. 2.

When the coil is at rest or not rotating, it has a normal or original diameter, indicated at X in FIG. 3, which is slightly less than the diameter of the bore 16, as indicated at Y. Accordingly, coil 20 may be easily inserted into and removed from the bore 16. Indeed, it can be seen in FIG. 3 that an annular clearance 28 is provided between the bore 16 and coil 20 when the coil is disposed at rest. Note that the coil is wound in a first direction of rotation, indicated by arrow 30 in FIG. 2, when viewed from end 22 and proceeding toward the opposite end 26.

Figure 4:
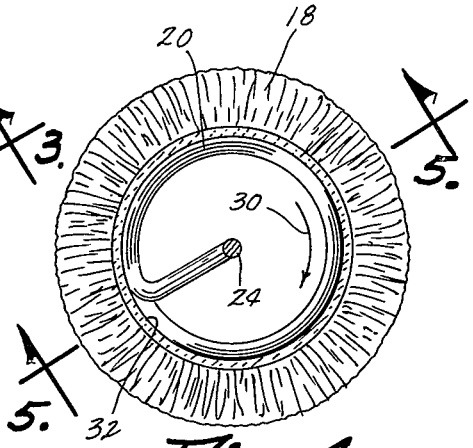
FIG. 4 is a partially sectional longitudinal view of the apparatus showing the paint roller pad being rotated therewith.
Figure 5:
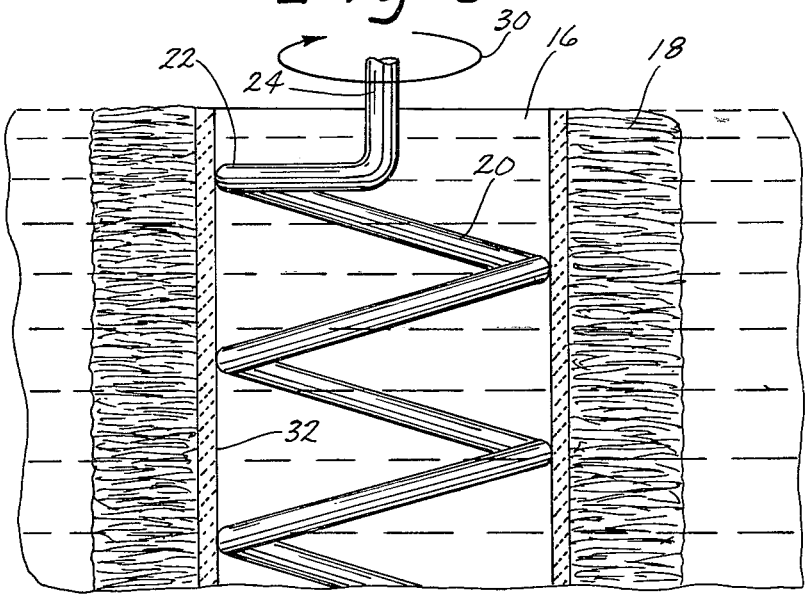
FIG. 5 is a further enlarged transverse sectional view taken along line 5—5 in FIG. 4.

Referring to FIGS. 4 and 5, rotation of the shank 24 by the electric drill 14 in the direction of arrow 30 causes the coil 20 to unwind and thereby expand radially to the extent of generally circumferentially engaging the interior side wall 32 of bore 16. The radial expansion forces cause the rotating coil to initially frictionally engage the side wall 32 until the roller pad attains the speed of rotation of the coil, whereupon the coil and side wall 32 are positively engaged and rotate in unison.

With the roller pad 18 thus supported on and rotated by the coil 20, only one hand is required for gripping the drill 14 and the painter's other hand is free to apply a cleaning solution or scrub the soft exterior portion of the pad to remove paint therefrom. Note that the rotary movement of the pad 18 by the coil 20 also effects a somewhat spin drying of the pad after it is cleaned.

When the drill is turned off, the coil slows and eventually ceases rotation whereupon it returns to its original diameter and may be easily withdrawn from the roller pad 18.

The coil 20 may be formed of spring steel, plastic or such other material as will provide the resiliency necessary for radial expansion of the coil when it is rotated, as described.

It will be apparent that the apparatus of the invention is not limited to the rotation of the paint roller pads but may be utilized as well for rotating other objects having an elongated bore so long as the coil is properly sized relative to the bore so as to be insertable therein and expandable to firmly engage the bore side wall. For clarity, the term bore is used herein to generally designate an elongated opening and is not to be construed as including any limitation as to the method of forming the opening.

The method contemplated by the present invention for rotating a generally cylindrical paint roller includes providing an elongated coil having an outside diameter less than the inside diameter of the roller pad, axially inserting the coil into the bore of the pad, and rotating the coil in a direction to unwind the same, thereby radially expanding the coil and causing the same to circumferenentially engage the roller pad for rotating the pad.

Thus there has been shown an described and apparatus and method for rotating an object having an elongated bore therein which accomplishes at least all of the stated objects.

I claim:

1. In a method of cleaning a generally hollow cylindrical paint roller pad wherein paint is removed from an exterior portion of the pad, the improvement comprising, providing an elongated coil having an outside diameter less than the inside diameter of said paint roller pad, axially inserting said coil into the bore of said roller pad, and rotating said coil in a direction to unwind the same thereby radially expanding said coil to generally circumferentially engage said roller pad along the length thereof and rotating the pad therewith while removing paint from the exterior portion of the pad.

2. The method of claim 2 wherein said coil includes a shank integrally connected to and extending from one end of the coil along the axis thereof, said coil being wound in one direction of rotation when proceeding from said one end to the opposite end thereof, and the step of rotating said coil comprising rotating said coil in said one direction.

* * * * *